United States Patent [19]

Newman et al.

[11] 4,302,066

[45] Nov. 24, 1981

[54] SAFETY LOCKING MEANS FOR INDUSTRIAL GRADE ELECTRICAL CONNECTORS

[75] Inventors: Albert P. Newman; Ronald A. Hertzer, both of Cincinnati, Ohio

[73] Assignee: Empire Products, Inc., Cincinnati, Ohio

[21] Appl. No.: 64,501

[22] Filed: Aug. 7, 1979

[51] Int. Cl.[3] ..... H01R 13/639

[52] U.S. Cl. ..... 339/82; 339/75 R; 339/126 RS; 339/132 R

[58] Field of Search ..... 339/75 R, 75 P, 75 A, 339/75 M, 82, 89 R, 89 M, 89 C, 91 R, 126, 132 R, 204, 136 R, 136 C, 136 M

[56] References Cited

U.S. PATENT DOCUMENTS

| | | | |
|---|---|---|---|
| 2,962,688 | 11/1960 | Werner | 339/89 M |
| 3,133,777 | 5/1964 | Anhalt | 339/91 R |
| 3,360,763 | 12/1967 | Rongey et al. | 339/91 R |
| 3,784,964 | 1/1974 | Newman et al. | 339/219 R |

FOREIGN PATENT DOCUMENTS

| | | | |
|---|---|---|---|
| 813284 | 5/1959 | United Kingdom . | |
| 963676 | 7/1964 | United Kingdom | 339/91 R |
| 1009179 | 11/1965 | United Kingdom | 339/126 |
| 1253981 | 11/1971 | United Kingdom . | |
| 1553773 | 10/1979 | United Kingdom . | |
| 2020917 | 11/1979 | United Kingdom . | |

*Primary Examiner*—John McQuade
*Attorney, Agent, or Firm*—Frost & Jacobs

[57] ABSTRACT

Safety locking structure to prevent unintentional disconnection of a mating pair of male and female electrical connectors. The locking structure comprises a hollow tubular shell and a U-shaped clevis pin having a base portion and a pair of legs. The mating end of a first one of the electrical connectors is insertable into the shell from one end thereof and is captively held therein. The other end of the shell is provided with two pairs of aligned holes, each pair being adapted to receive a leg of the U-shaped clevis pin with a portion of each clevis pin leg extending into the interior of the shell. The mating end of the second one of the connectors is insertable into the shell from the other end thereof and into mating relationship with the first connector. The mating end of the second connector is provided with an exterior annular clevis pin locking groove which, when the connectors are fully mated, receives the above noted portions of the clevis pin legs to lock the second connector in mated relationship with the first connector. The shell may be configured to captively mount the first connector to a panel or to make an in-line connection between a mating pair of male and female connectors, the first of the connectors being captively mounted in the shell in the same manner described with respect to the second connector.

26 Claims, 10 Drawing Figures

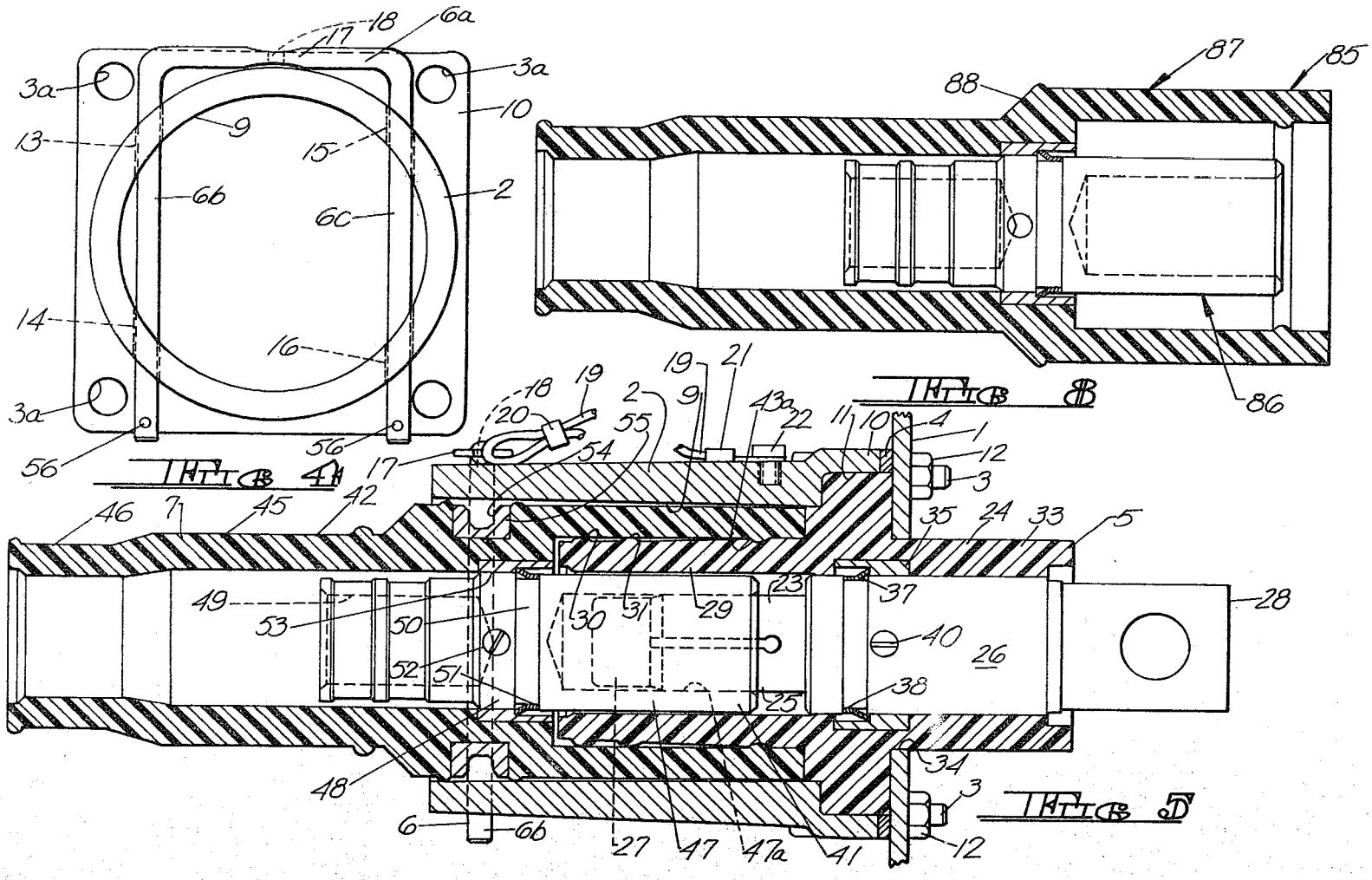

SAFETY LOCKING MEANS FOR INDUSTRIAL GRADE ELECTRICAL CONNECTORS

TECHNICAL FIELD

The invention relates to locking means for electrical connectors and more particularly to such locking means as applied to relatively large industrial electrical connectors.

BACKGROUND ART

As used herein, the phrase "industrial electrical connectors" is simply intended to distinguish the type of electrical connectors to which the present invention is directed, as opposed the typical household electrical connectors. The present invention is directed to connectors of the general class taught in U.S. Pat. Nos. 3,662,296 and 3,784,964. While their precise nature and configuration and the nature and configuration of the individual elements of such industrial connectors do not constitute a limitation of the present invention, in their simplest form, such connectors are provided as a cooperating male and female pair. The male connector comprises a male contact mounted within an insulative housing. The rearward end of the male contact is provided with means by which it may be connected to a cable or a bus bar. The female connector comprises a female contact mounted in insulative housing. The female contact is provided at its rearward end with means by which it may be connected to a cable or a bus bar. When the cooperating pair of connectors is in its mated or connected condition, the male contact is received within the female contact and a portion of the insulative housing of one of the connectors is received within a portion of the insulative housing of the other so that the male and female contacts are totally enclosed. In many industrial connectors, the insulative housings of a mated pair of connectors form a weather-proof seal about the contacts.

Prior art workers have devised a number of means by which such connectors may be locked together to prevent unintentional disconnection. One such locking means involves the provision of cam surfaces and cam surface engaging means in association with the male and female contacts so that when the male contact is inserted into the female contact and rotated relative thereto, the contacts will be in locked engagement. Such an arrangement is taught, for example, in U.S. Pat. No. 3,226,667. U.S. Pat. No. 3,755,772 teaches electrical connectors having exterior locking means. Some prior art connectors require tools to connect or disconnect them.

Many connector manufacturers use a threaded coupler to secure the connectors together. U.S. Pat. No. 3,029,407 is exemplary of such an arrangement. A threaded coupler is characterized by several disadvantages. The threads are easily damaged by handling or dropping on hard surfaces. Dirt frequently builds up in the threads. If the coupler becomes distorted from rough handling, the threads will not mate. Finally, it is time consuming to mate such couplers, expensive to machine the threads and the threads tend to seize and gall from dirt and corrosion.

The present invention provides a safety locking structure to prevent unintentional disconnection of a mating pair of male and female industrial electrical connectors utilizing the combination of a hollow shell structure, at least one U-shaped clevis pin and a locking pin groove on at least one of the male and female connectors. A clevis pin, per se, is not new as is evidenced by U.S. Pat. No. 3,397,012 wherein a U-shaped clevis pin is utilized as a retaining means to maintain a rotatable cutter bit for a mining machine or the like within its mounting means.

The unique combination of shell, at least one U-shaped clevis pin and a locking pin groove on at least one of the connectors, as taught herein, provides a locking system which eliminates the possibility of accidental disengagement of the electrical connectors which could otherwise cause disruption of service and electrical shock hazards. This locking system is easy and inexpensive to manufacture, simple in design and readily and quickly installable. No twisting of one electrical connector with respect to the other is required and the electrical connectors may be locked and unlocked without the use of tools or the like. The locking system can further be, itself, locked so that only authorized personnel can disengage the electrical connectors.

In the embodiments of the present invention, the clevis pin does not become inoperative due to dirt or corrosion. If the clevis pin becomes bent, it can be readily straightened and used. The locking means of the present invention enables the connectors to be quickly and easily locked or unlocked and the locking is positive.

DISCLOSURE OF THE INVENTION

According to the invention there is provided a safety locking structure to prevent unintentional disconnection of a mating pair of male and female electrical connectors. The locking structure comprises a hollow tubular shell and at least one U-shaped clevis pin having a base portion and a pair of legs. The mating end of a first one of the electrical connectors is insertable into the shell from one end thereof and is captively held therein. The other end of the shell is provided with two pairs of aligned holes, each pair being adapted to receive a leg of the U-shaped clevis pin. When the U-shaped clevis pin is fully seated in the pairs of holes, the free end of each leg extends exteriorally of the shell. A portion of each leg, located between the pair of perforations through which it passes, extends into the hollow interior of the shell.

The mating end of the second one of the connectors is insertable in that end of the shell opposite the end into which the mating portion of the first one of the connectors extends. When the second one of the connectors is so inserted in the shell, it will simultaneously achieve mating relationship with the mating end of the first one of the connectors. The mating end of the second connector is provided with an exterior annular clevis pin groove which, when the connectors are fully mated within the shell, is in alignment with the above mentioned pairs of holes in the shell and receives those portions of the clevis pin legs which extend into the interior of the shell, thus locking the second connector in mated relationship with the first connector.

In one embodiment of the present invention, the shell is provided at that end into which the mating portion of the first one of the electrical connectors extends with a hollow base by which it may be mounted to a panel with bolts or the like. The hollow base accepts an appropriately configured flange on the first one of the connectors so that when the shell is mounted on a panel, it captively mounts the first one of the connectors to the panel, as well, so that the first one of the connectors serves as a receptacle.

A second embodiment of the present invention can be utilized to serve as a locking structure for an in-line connection when the male and female connectors are each attached to its own respective cable length. In this instance, the shell constitutes a simple, hollow, tubular, sleeve-like structure. The shell is provided with two pairs of holes near each of its ends so that a clevis pin may be mounted near each of the shell ends. In such an instance, both of the electrical connectors are provided with annular clevis pin grooves. Under these circumstances, the connectors are inserted into the shell from opposite ends thereof and are brought into mating relationship therein, whereupon each of the electrical connectors is locked into position by its own respective clevis pin. It would be within the scope of the invention to mount one of the connectors in the shell semi-permanently, as will be described.

In both embodiments of the present invention, the one or two clevis pins may be captively attached to the shell by a chain, cable or the like. Means may also be provided to lock the one or two clevis pins in place so that their removal can be accomplished only by authorized personnel.

BRIEF DESCRIPTION OF THE DRAWINGS

FIG. 4 is a front elevational view of the shell of FIG. 1 illustrating the clevis pin mounted therein.

FIG. 5 is a fragmentary side elevational view, partly in cross section, illustrating the structure of FIG. 1 with the electrical connectors in mated and locked condition.

FIG. 8 is a side elevational view, partly in cross section, of an exemplary connector for use with either embodiment of the present invention.

BEST MODE OF CARRYING OUT THE INVENTION

While not intended to be so limited, the present invention will be described in terms of its application to single conductor connectors used, for example, in oil drilling applications and the like. Such connectors can be used wherever a high-amperage, AC or DC connection is required. The connectors can, for example, be used to carry power from generators to switch gear, to SCR controllers, and to traction motors, including mud pumps, drawworks, rotary tables, cement pumps and the like. The connectors also have numerous offshore applications.

Figure 1:
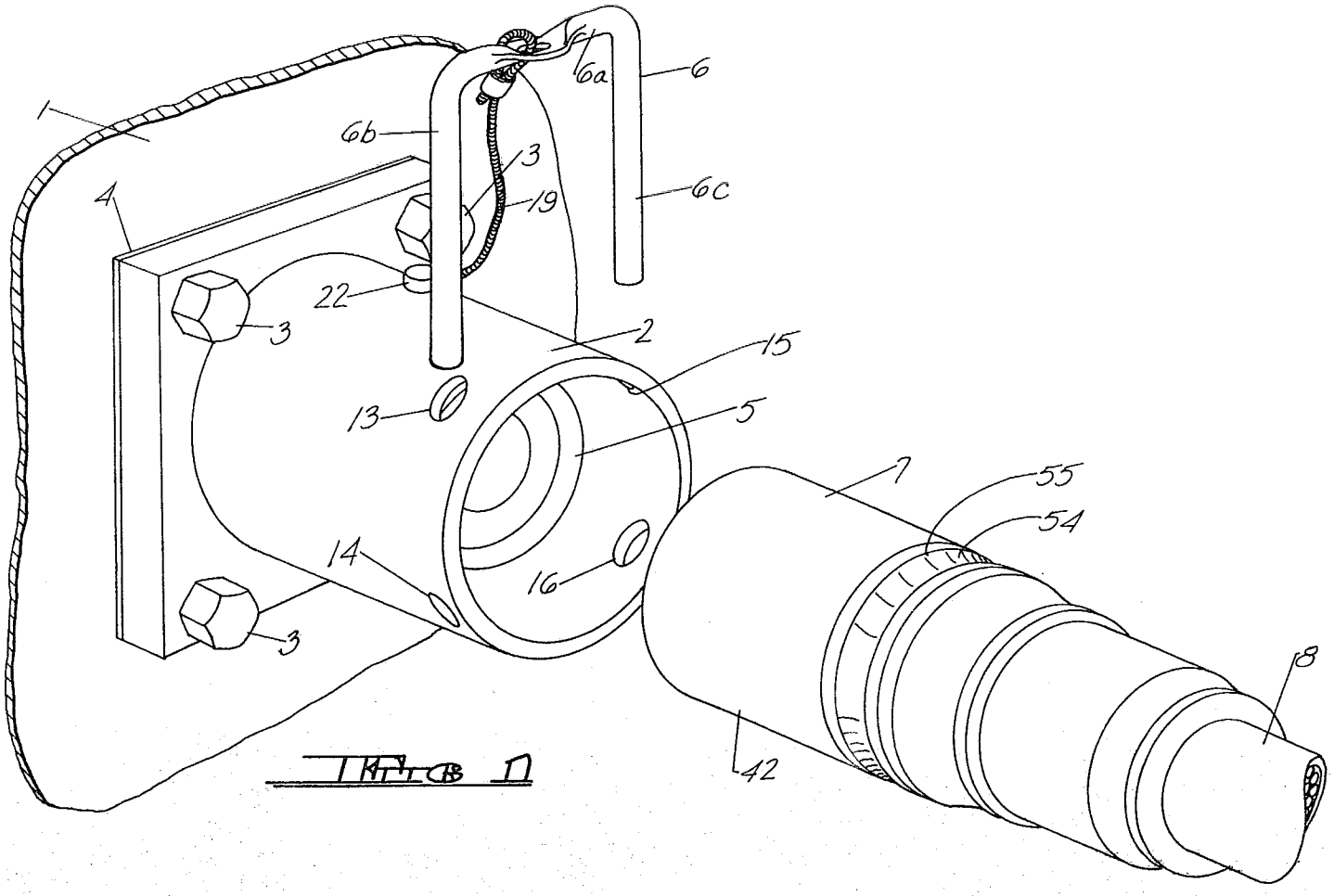
FIG. 1 is a fragmentary, exploded, perspective view illustrating a panel mounted first connector and shell, a clevis pin and a second connector.

Turning first to FIG. 1, a panel is indicated at 1. A shell of the present invention is shown at 2 mounted to the panel by bolts 3 or other suitable fastening means. A gasket 4 is provided between the shell 2 and the panel and a first connector 5 is captively mounted in the shell 2 so as to serve as a receptacle. The shell is provided with a U-shaped clevis pin 6. Finally, FIG. 1 illustrates a second connector 7 attached to the end of a cable 8.

Figure 2:
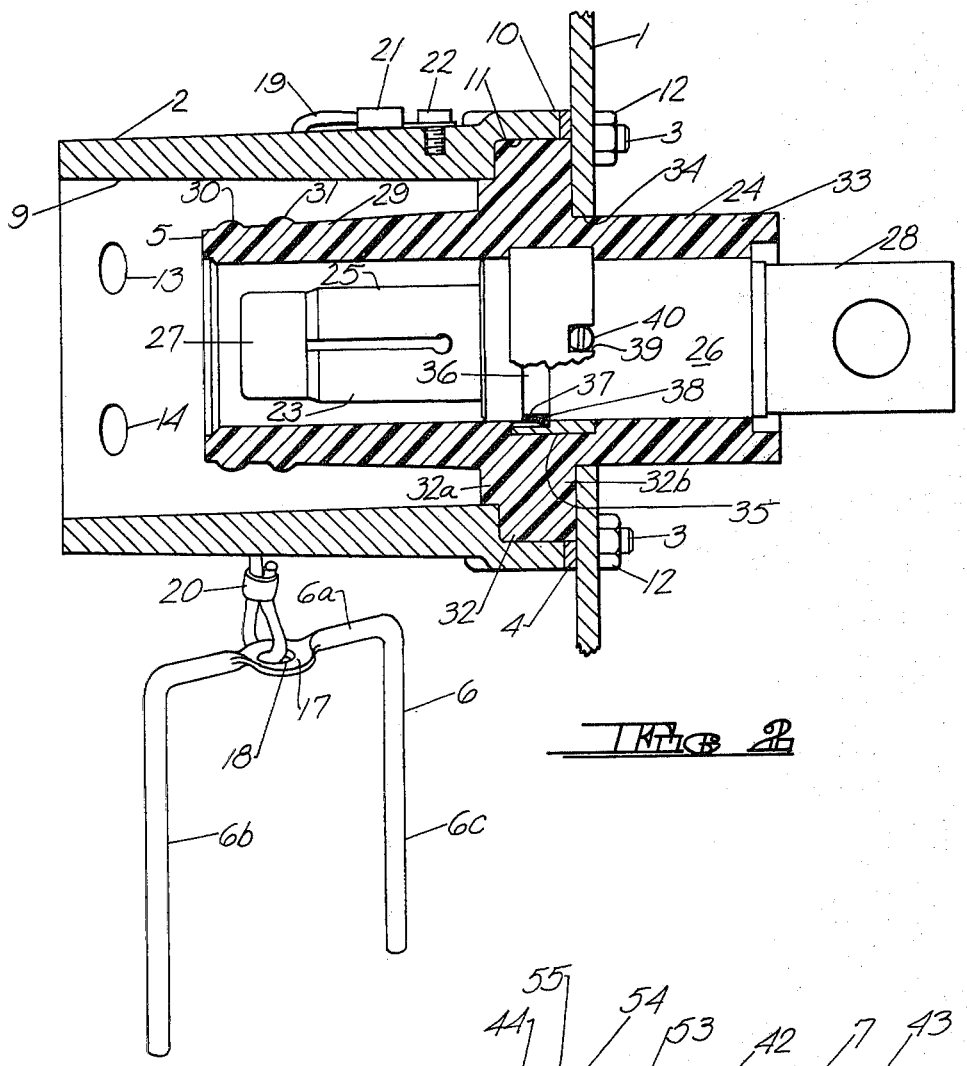
FIG. 2 is a fragmentary side elevational view, partly in cross section, illustrating the panel mounted first electrical connector, shell and clevis pin of FIG. 1.

The structure of the first embodiment of the present invention having been identified by its major parts with respect to FIG. 1, these parts will now be described in detail. Reference is first made to FIG. 2, wherein like parts have been given like index numerals. The hollow shell 2 has a substantially cylindrical exterior configuration. Its interior surface 9 is slightly tapered as shown. At its rearward end, the shell has a rectangular, integral base portion 10 having a circular cavity 11 formed therein. The base portion 10 has a bore **3*a* at each of its corners for receipt of bolts 3 (see FIG. 4). The bolts 3 pass through appropriate perforations (not shown) in the panel 1 and are provided with nuts 12. It will be understood that other forms of fastening means, well known in the art, can be used to attach the shell 2 to panel 1. Near its forward end, shell 2 is provided with two pairs of perforations 13-14 and 15-16, all four of which are shown in FIGS. 1 and 4**. The purpose of these perforations will be described hereinafter.

As indicated above, the shell 2 is provided with a U-shaped clevis pin 6. The clevis pin 6 has a base portion **6*a* and a pair of parallel legs 6*b* and 6*c*. Preferably, clevis pin 6 is captively attached to shell 2. This can be accomplished in any appropriate manner. For purposes of an exemplary showing, the base portion 6*a* of clevis pin 6 is shown as having a flat 17 formed therein with a perforation 18 therethrough. One end of a flexible cable is looped through the perforation 18 and is appropriately clamped as at 20. The other end of cable 19 is provided with a clamp-type eyelet 21 adapted to receive a screw 22 threadedly engaged in the shell 2. It will be understood that the screw 22** could constitute a rivet or any other appropriate fastening means.

For purposes of an exemplary showing, the electrical connector 5 is illustrated as being of the male-type. To this end, the electrical connector 5 comprises a male contact 23 and a surrounding insulative housing 24 of synthetic rubber or the like. The male contact 23 has a contact portion 25 and a body portion 26. The forwardmost end of contact portion 25 may be provided with an insulative tip 27 to minimize shock hazard, as taught in U.S. Pat. No. 3,662,296.

The contact body portion 26 may be provided with an axial cavity to receive the end of a cable. Alternatively, the contact body portion 26 may terminate at its rearward end in a bus bar connection as shown at 28.

The insulative housing 24 has a forward cylindrical portion 29 the exterior surface of which tapers slightly forwardly and is provided with a pair of integral annular ribs 30 and 31. The interior diameter of the forward cylindrical portion 29 is of a diameter larger than the contact portion 25 of male contact 23 so as to accommodate the female contact, as will be evident hereinafter.

The insulative housing 24 has an integral circular flange 32, a first portion 32*a* of which is of such diameter as to be just nicely received within the cylindrical portion of shell 2. The flange 32 has a second portion 32*b* of larger diameter so as to be just nicely received in the circular cavity 11 of the shell base portion 10. It will be noted that flange portion 32*b* is slightly wider than the depth of shell cavity 11 so that a small part of flange portion 32*b* extends rearwardly of the shell base portion.

The insulative housing 24 has a final cylindrical portion 33 which extends through a circular opening 34 in panel 1 and surrounds the body portion 26 of male contact 23.

The male contact 23 may be maintained in the insulative housing 24 in any suitable manner. For purposes of an exemplary showing, the insulative housing 24 is shown as being provided with a stepped retaining ring 35. The body portion 26 of male contact 23 has an annular groove 36 formed therein. A resilient locking ring 37 is located in the annular groove 36 and is provided with upwardly extending resilient tines 38 which cooperate with the stepped retaining ring 35 to prevent rearward removal of the male contact 23 from the insulative housing 24. The retaining ring 35 is also provided with a notch 39 adapted to receive the head of a screw 40 mounted in the body portion 26 of male contact 23. The interaction of screw 40 and notch 39 prevents forward removal of the male contact from housing 24.

When the shell 2 and electrical connector 5 are mounted on panel 1, the gasket 4 and the portion 32*b* of the insulative housing annular flange 32 are compressed by bolts 3 to assure that the mounting of the sleeve 2 to panel 1 is a weather proof mounting.

Figure 3:
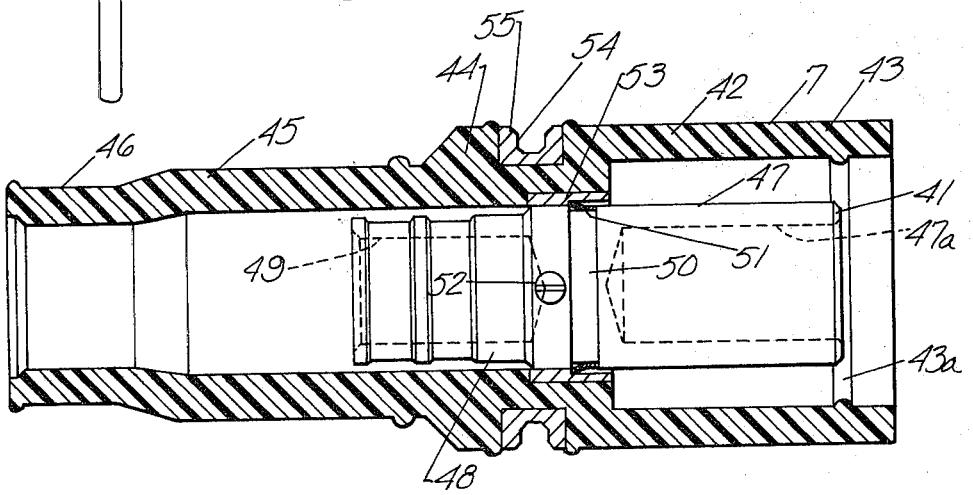
FIG. 3 is a side elevational view, partly in cross section, illustrating the second electrical connector of FIG. 1.

FIG. 3 illustrates a connector 7 adapted to cooperate with connector 5. For purposes of an exemplary illustration, connector 7 is illustrated as being of the female type and is in general of conventional configuration. Connector 7 comprises a female contact 41 and a hollow insulative housing 42. The insulative housing 42 has a forward cylindrical portion 43 having an internal diameter sufficiently larger than the diameter of the female contact 41 as to accommodate the forward portion 29 of the insulative housing 24 of connector 5. The interior surface of forward portion 43 may be provided with an annular rib 43*a*, the purpose of which will be evident hereinafter. The insulative housing 42 has a central portion 44 of greater thickness than the remainder of the housing and a rear portion 45. The rear portion 45 has an annular surface 46 which may accommodate a hose clamp or the like (not shown) to clamp the rearward end of the housing against cable 8 (see FIG. 1). Female contact 41 has a forward contact portion 47 having an axial bore 47*a* adapted to receive the forward contact portion 25 of male contact 23 to complete the electrical connection. Female contact 41 also has a body portion 48. The body portion 48 may have a rearward axial bore 49 adapted to receive the uninsulated end of cable 8. Again, female contact 41 may be maintained within insulative housing 42 in any appropriate manner. For purposes of an exemplary showing, it is illustrated as being maintained in housing 42 in the same manner described with respect to male contact 23. To this end, the female contact is provided with an annular notch 50 with a tined locking ring 51 located therein. The body portion 48 of female contact 41 is also provided with a screw 52 similar to screw 40 of FIG. 2. Finally, the insulative housing 42 has a stepped retaining ring 53 mounted therein adapted to cooperate with locking ring 51 and screw 52 in the same manner described with respect to FIG. 2. The connector 7 differs from a conventional connector primarily in that it is provided with an annular clevis pin locking groove 54. While the locking groove 54 may be formed directly in the insulative housing 42, it is preferable that the clevis pin locking groove 54 be formed in a ring 55 of aluminum or other appropriate metal molded into the insulative body 42. This provides a positive, metal-to-metal seating for clevis pin 6, as will be evident hereinafter. The ring 55 could also be made of plastic or other suitable non-metallic material.

Reference is now made to FIG. 4 wherein like parts have been given like index numerals. FIG. 4 illustrates shell 2 alone with clevis pin 6 fully mounted therein. It will be noted from FIG. 4 that when clevis pin 6 is fully seated in shell 2, the clevis pin leg 6*b* passes through the pair of perforations 13 and 14 in the shell. Similarly, clevis pin leg 6*c* passes through the pair of perforations 15 and 16 in shell 2. When fully seated, the base portion 6*a* of the clevis pin will contact the upper surface of shell 2 unless prevented from doing so by the presence of the loop of retaining cable 19 not shown in FIG. 4. In any event, the free ends of clevis pin legs 6*b* and 6*c* extend exteriorly of shell 2, as shown in FIG. 4. One or both of these free ends may be provided with transverse perforations 56, if desired. A wire seal or other captive means may be passed through one or both of perforations 56 to assure against unauthorized removal of clevis pin 6 from shell 2.

It will be noted from FIG. 4 that those portions of clevis pin legs 6*b* and 6*c* extending between perforations 13 and 14 and perforations 15 and 16, respectively, extend inwardly of the interior surface 9 of shell 2. It is these portions of clevis pin legs 6*b* and 6*c* which will engage the clevis pin locking groove 54 of electrical connector 7 (see FIG. 3) as will be described next.

FIG. 5 illustrates the structures of FIGS. 2 and 3 in their fully mated and locked condition. Again, like parts have been given like index numerals. The insulative member 27 and contact portion 25 of male contact 23 are received within the axial bore 47*a* of the contact portion 47 of female contact 41 to establish a good electrical contact. It will be noted that the annular ribs 30 and 31 of the forward portion 29 of insulative housing 24 bear against the inside surface of the forward portion 43 of insulative housing 42 while the annular rib 43*a* of the forward portion 43 of insulative housing 42 bears against the exterior of the portion 29 of insulative housing 24 assuring a watertight and weather proof seal between insulative housings 24 and 42 which fully enclose male and female contacts 23 and 41. When connectors 5 and 7 are fully mated as shown in FIG. 5, the clevis pin 6 may be seated in the sleeve perforations 13-14 and 15-16. This will result in the central portions of clevis pin legs 6*b* and 6*c* being located in the annular clevis pin locking groove 54 of connector 7 thereby preventing inadvertent disconnection of electrical connector 7 from electrical connector 5.

Figure 6:
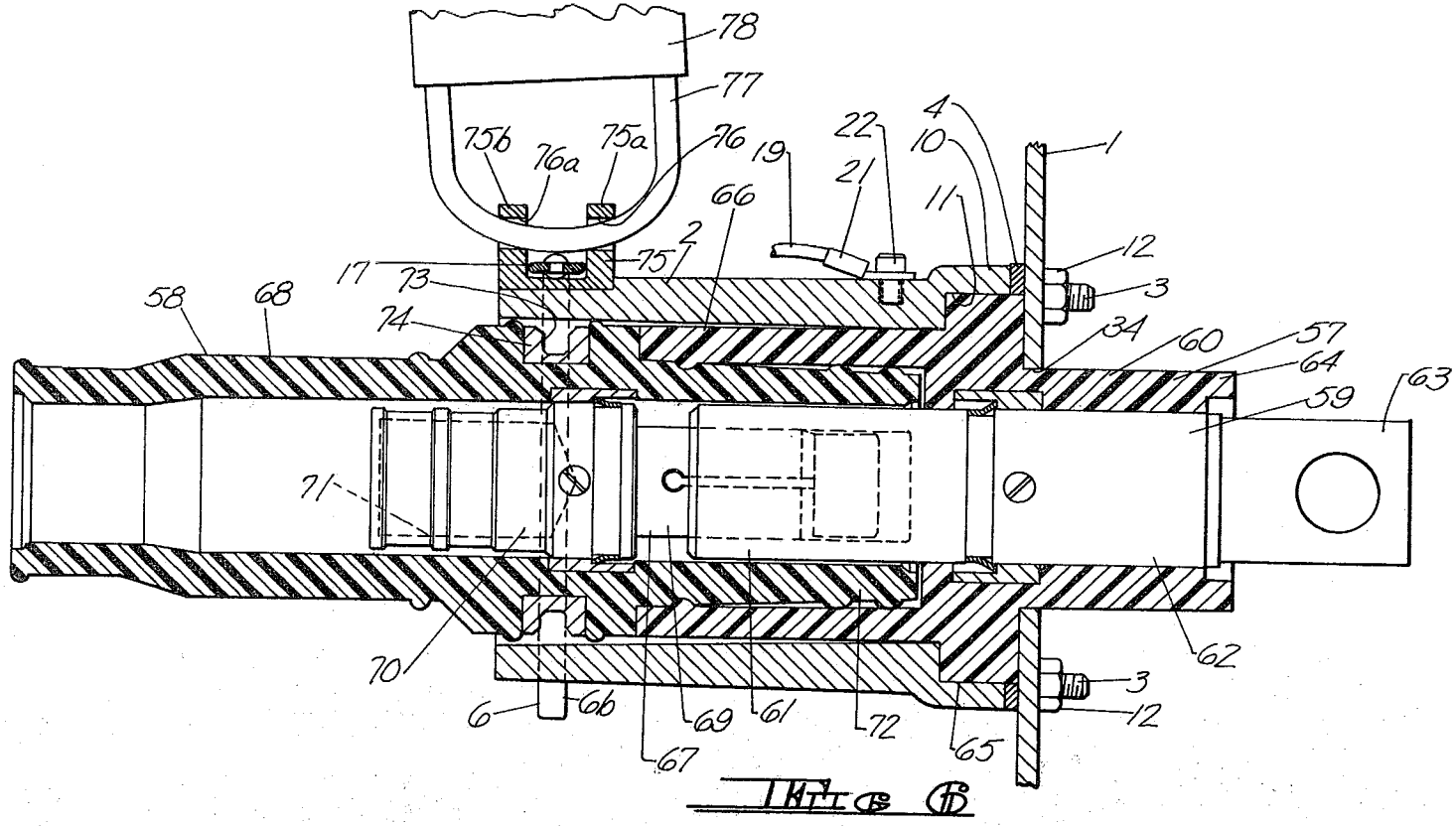
FIG. 6 is a fragmentary side elevational view, partly in cross section, and similar to FIG. 5, but illustrating the first connector as being a female connector and the second connector as being a male connector and also illustrating means to lock the clevis pin in place.

Reference is now made to FIG. 6 which is similar to FIG. 5. In FIG. 6, the shell 2 is shown mounted on the panel 1 and provided with a clevis locking pin 6, all identical to that shown in FIG. 5. FIG. 6 differs from FIG. 5 in that the electrical connector 57 mounted on panel 1 by shell 2 is in this instance a female connector, while connector 58 captively held in shell 2 by clevis pin 6 is a male connector. To this end electrical connector 57 comprises a female contact 59 located in an insulative housing 60. The female contact 59 comprises a forward contact portion 61 and a body portion 62. Again, while body portion 62 may be provided with a rearward axial bore to receive the end of a cable, for purposes of an exemplary showing it is illustrated as having a bus bar connection 63 similar to the bus bar connection 28 of FIGS. 2 and 5.

The insulative housing 60 of connector 57 has a rear cylindrical portion 64 similar to rear cylindrical portion 33 of FIG. 2 and an annular flange 65 similar to and serving the same purpose as annular flange 32 of FIG. 2. Insulative housing 57, however, has a forward portion 66 similar to the forward portion 43 of insulative housing 42 of FIG. 3.

The male-type connector 58 comprises a male contact 67 and an insulative housing 68. The male 67 has a contact portion 69 and a body portion 70 having a rearward axial bore 71 to receive the end of a cable. The insulative housing 68 is similar to insulative housing 42 of FIG. 3 with the exception that its forward end 72 is substantially identical to the forward end 29 of insulative housing 24 of FIG. 2. Insulative housing 68 is provided with a clevis pin locking groove 73 formed on a metallic ring 74, identical to the clevis pin locking groove 54 and ring 55 of FIG. 3. Thus, when electrical connector 58 is fully mated with electrical connector 57 within shell 2, the clevis pin 6 may be inserted in perforations 13-14 and 15-16 of shell (see FIG. 4) to lock or captively hold connector 58 in its mated relationship with connector 57 and to prevent inadvertent disconnection thereof.

FIG. 6 also illustrates an integral lug element 75 mounted on shell 2 so as to receive the base portion 17 of clevis pin 6 between the upstanding lugs 75*a* and 75*b* of lug element 75. The upstanding lugs 75*a* and 75*b* are provided with transverse bores 76 and 76*a* adapted to receive the shackle 77 of a padlock 78. When the padlock is in the position shown in FIG. 6, the shackle 77 overlies the clevis pin 6 preventing its removal from shell 2 until the padlock shackle 77 has been removed from the perforations 76 and 76*a* of lugs 75*a* and 75*b*. In this way, it can be assured that only authorized personnel can disconnect the electrical connectors 57 and 58. It will be understood that the shell illustrated in FIGS. 1 and 2 could similarly be provided with an upstanding lug element equivalent to lug element 75. It will further be understood that lugs 75*a* and 75*b* could constitute an integral one-piece part of shell 2. The clevis pin 6 can still be made captive by a cable 19 or the like in the manner described with respect to 2 by simply forming the flat 17 and perforation in that part of clevis pin base 6*a* which is not located between lugs 75*a* and 75*b*. While a padlock 78 is shown as the locking means used with lugs 75*a* and 75*b*, any other suitable locking means can be used, even including a simple bolt, pin or the like.

Figure 7:
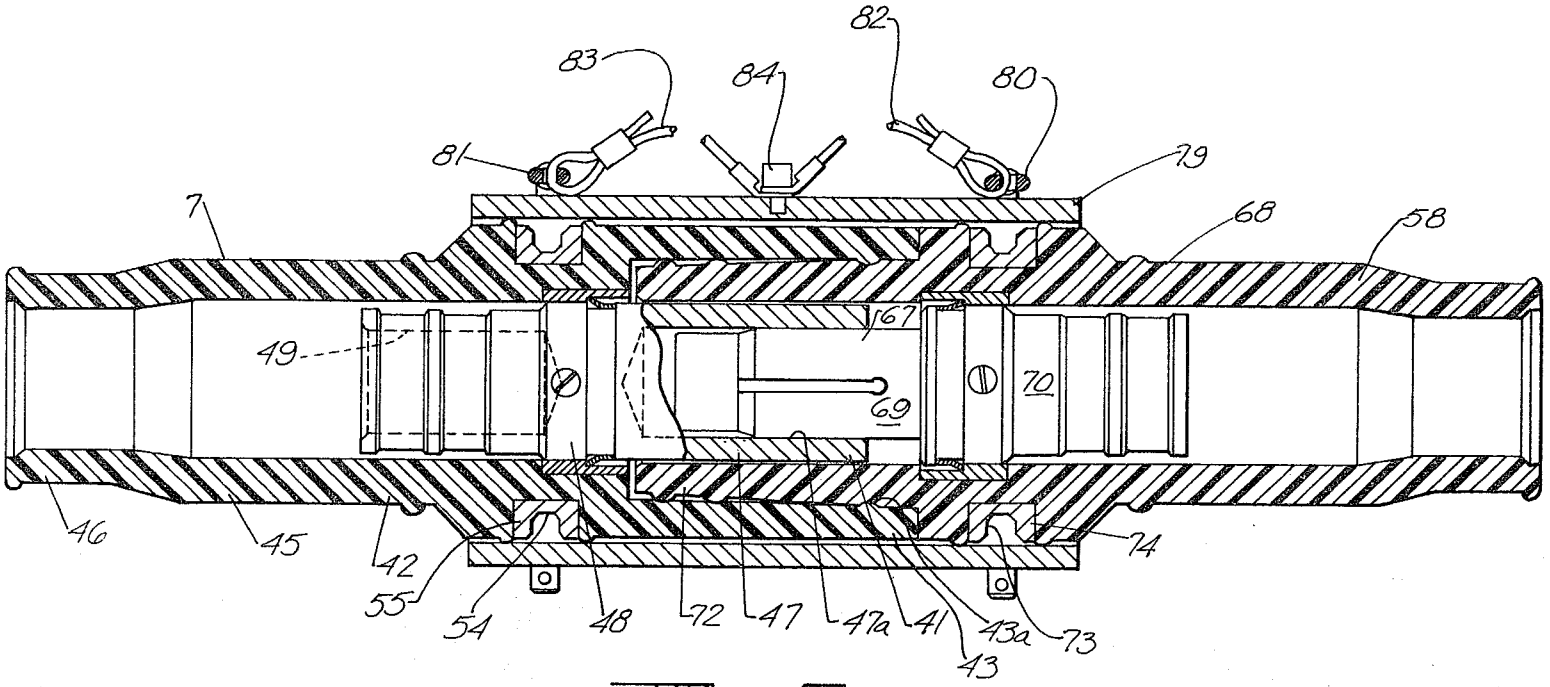
FIG. 7 is a side elevational view, partly in cross section, illustrating a second embodiment of the present invention for an in-line connection with a pair of male and female connectors in mating relationship within a sleeve, each connector being locked in place by its respective clevis pin.

FIG. 7 illustrates how the shell and the clevis pin arrangement of the present invention can be used to lock electrical connectors forming an in-line connection. To this end, FIG. 7 illustrates a male connector identical to male connector 58 of FIG. 6 and like parts have been given like index numerals. FIG. 7 also illustrates a female connector 7 identical to female connector 7 of FIG. 3 and again like parts have been given like index numerals. Both connectors 7 and 58 are intended to be attached to the ends of their respective cable lengths (not shown) to be joined.

In the embodiment of FIG. 7, a shell 79 is provided. In this instance, the shell 79 may constitute a simple hollow cylindrical member having an internal diameter to just nicely receive electrical connectors 7 and 58. Near each of its ends, the shell 79 is provided with two pairs of holes equivalent to pairs of holes 13-14 and 15-16 of shell 2 (see FIGS. 1 and 4). These pairs of holes are not visable in the view illustrated in FIG. 7, but it will be understood by one skilled in the art that they will be so positioned with respect to shell 79 as to be in alignment with the clevis pin locking groove 54 of connector 7 and the clevis pin locking groove 73 of connector 58.

The shell 79 will also be provided with a pair of clevis pins 80 and 81. The clevis pins 80 and 81 will be identical to clevis pin 6 of FIGS. 1 and 4. Both clevis pins 80 and 81 may be rendered captive on shell 79 by any appropriate means such as cables 82 and 83 respectively. The cables 82 and 83 again may be indentical to cable 19 described with respect to FIG. 2. The free ends of cables 82 and 83 may be attached to a screw 84 equivalent to screw 22 of FIG. 2.

In operation, when a connection is to be made between electrical connectors 7 and 58, the connectors are fully mated within shell 79 and clevis pins 80 and 81 are inserted in their respective pairs of perforations in shell 79 with clevis pin 80 engaging the clevis pin locking groove 73 of connector 58 and clevis pin 81 engaging the clevis pin locking groove 54 of connector 7. It will be understood by one skilled in the art that when the in-line connection is fully made as illustrated in FIG. 7, both electrical connector 7 and electrical connector 58 will be captively held in shell 79 against inadvertent disconnection. It would be within the scope of the present invention to provide shell 79 with an upstanding lugs (similar to lugs 75*a* and 75*b* of FIG. 6) adjacent each of clevis pins 80 and 81 so that they both could be locked, if desired.

FIG. 8 illustrates an electrical connector generally indicated at 85. The electrical connector 85 is, for purposes of an exemplary showing, illustrated as being of the female type, having a female connector generally indicated at 86. Female connector 86 is identical to female connector 41 of FIGS. 3 and 7. The female connector 86 is surrounded by an insulative housing, generally indicated at 87. The insulative housing is substantially identical to insulative housing 42 of FIGS. 3 and 7. Insulative housing 87 of FIG. 8 differs from insulative housing 42 of FIGS. 3 and 7 in that it is provided with an annular shoulder 88 at approximately the position of clevis pin locking groove 54 of insulative housing 42. Thus, if the connector 85 were to be substituted for electrical connector 7 in the assembly of FIG. 5, the clevis pin 6, when inserted in sleeve 2 would abut annular shoulder 88 and thereby prevent inadvertent disconnection of the electrical connectors. Similarly, if electrical connector 85 of FIG. 8 were substituted for electrical connector 7 in the assembly of FIG. 7, its annular should 88 would be abutted by clevis pin 81 to prevent inadvertent removal of the electrical connector from shell 79. It will further be understood that electrical connector 58 of FIG. 7 could be provided with an annular shoulder, equivalent to annular shoulder 88 of FIG. 8, instead of the clevis pin locking groove 73.

The shell 2 of FIGS. 1, 2 and 4 through 6 could constitute a fabricated member of metal or the like or an integral, one-piece cast member of aluminum or other appropriate metal. Alternatively, the shell 2 could be molded of heavy duty plastic material. In similar fashion, the shell 79 of FIG. 7 could be a metallic or heavy duty plastic member.

Figure 9:
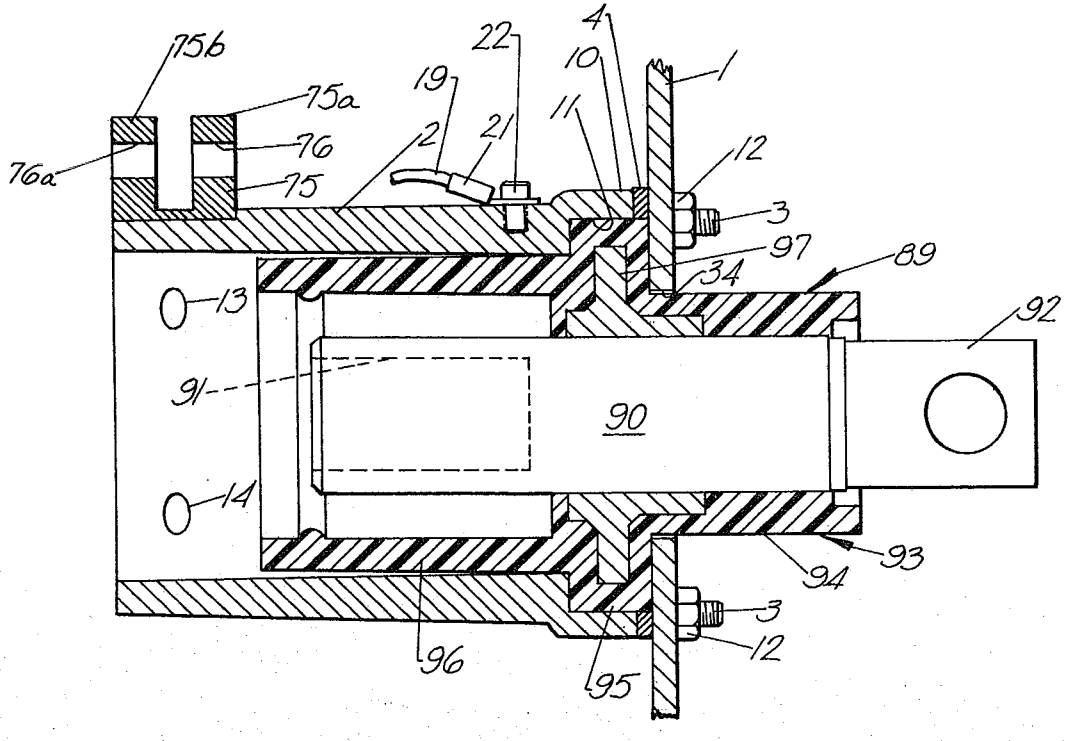
FIG. 9 is a fragmentary side elevational view, partly in cross section, illustrating a modification of the panel mounted connector of FIG. 6.

FIG. 9 illustrates a panel mounted connector, serving as a receptacle, similar to that shown in FIG. 6. The panel and shell are identical to those shown in FIG. 6 and like parts have been given like index numerals. For purposes of an exemplary showing, the connectors, serving as a receptacle, is illustrated as being of the female type and is generally indicated at 89. The connector 89 comprises a female connector 90 substantially cylindrical in configuration. At its forward end, the female connector is provided with a female cavity 91. For purposes of this showing, the female connector is illustrates as terminating in a bus bar connection 92.

The female connector 90 is surrounded by an insulative housing generally indicated at 93. The insulative housing comprises a rearward portion 94, an annular flange 95 and a forward portion 96 similar to rearward portion 64, annular flange 65 and forward portion 66 of the insulative housing 60 of FIG. 6. The connector 89 differs from connector 57 of FIG. 6 in that the connector is surrounded by an annular reinforcing member 97 located at the position of the insulative housing annular flange 95. The annular reinforcing member may be made of plastic, glass reinforced phenolic or the like. The insulative housing 93 is molded about contact 90 and reinforcing member 97. The reinforcing member 97 serves as a reinforcement for the insulative housing 93 in the area of its annular flange 95 and aids in maintaining the female contact properly axially aligned with respect to the insulative housing 93, thereby preventing distortion of the contact within the insulative housing.

Figure 10:
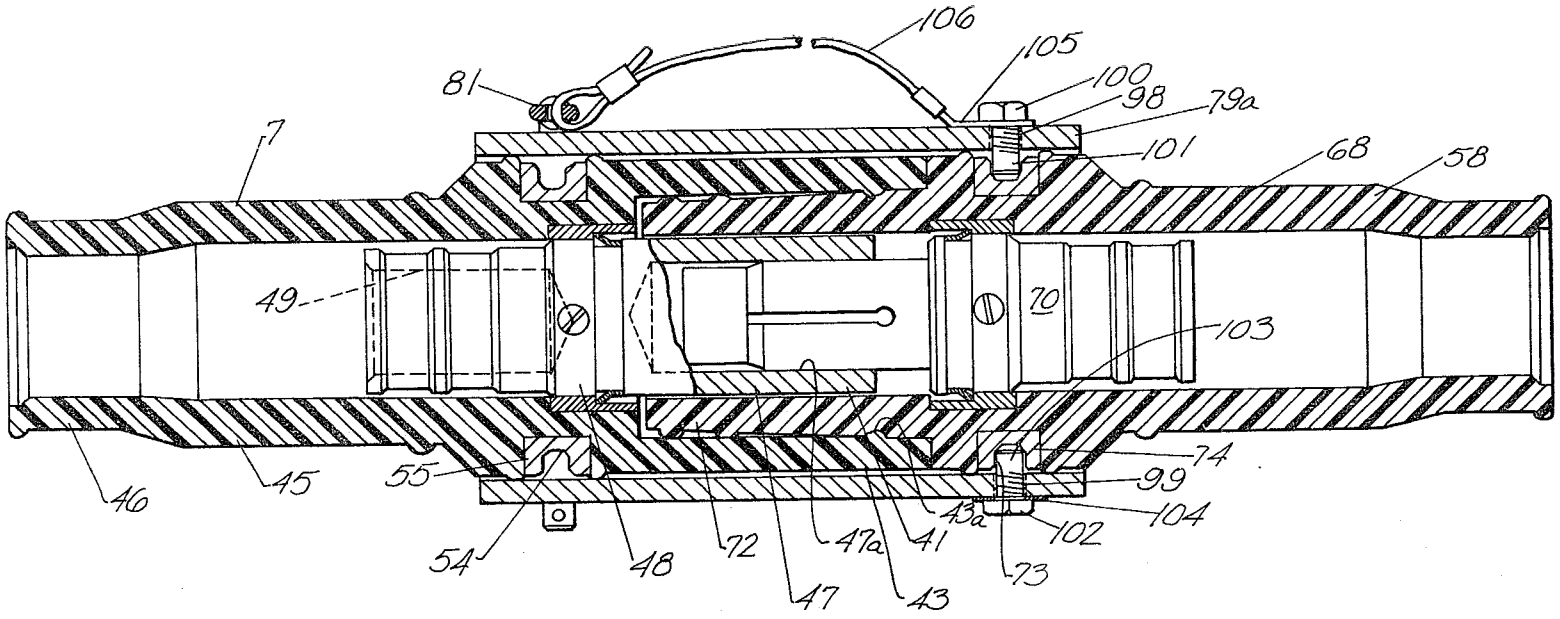
FIG. 10 is a side elevational view, partly in cross section, illustrating a modification of the embodiment of FIG. 7.

Reference is now made to FIG. 10 which illustrates a modification of the embodiment of FIG. 7. In FIG. 10, the male and female connectors 58 and 7 are identical to those shown in FIG. 7 and like parts have been given like index numerals. The shell **79*a* is substantially similar to shell 79 of FIG. 7. The shell is provided with pairs of holes (not shown) adjacent clevis pin locking groove 54 to accept clevis pin 81 in the same manner described with respect to FIG. 7. The other end of shell 79*a* (i.e., the right hand end as viewed in FIG. 10) is provided with a pair of diametrically opposed tapped holes 98 and 99. The tapped hole 98 is adapted to receive a bolt 100 having an unthreaded nose portion 101 which extends into clevis pin locking groove 73. Similarly, the threaded hole 99 is adapted to receive a bolt 102 having an unthreaded nose portion 103 extending into the same clevis pin locking groove. The bolts 100 and 102 may be provided with lock washers or the like, one of which is shown at 104. In this way, the shell 79*a* may be attached to connector 58 in a permanent or semi-permanent fashion. The bolt 100 may pass through and eyelet fitting 105 attached to a cable 106 rendering the clevis pin 81 captive on shell 79*a***.

A standard shell of the type shown at 79 in FIG. 7 may be modified by providing threaded holes similar to the holes 98 and 99 of FIG. 10. On the other hand, the shell may be originally provided with such threaded holes, the usual pairs of holes to receive a clevis pin being eliminated. It will further be understood that threaded holes similar to holes 98 and 99 and bolts similar to bolts 100 and 102 could be provided at the other end of shell **79*a* to render the shell permanently or semi-permanently attached to connector 7, rather than connector 58**.

Modifications may be made in the invention without departing from the spirit of it. For example, in all of the embodiments described the electrical connectors are illustrated as being of the single conductor type. It will be understood by one skilled in the art that the present invention could readily be applied to multiple conductor connectors without a change in its function or mode of operation. While the shells 2, 79 and **79*a*** are described as being substantially cylindrical, they could have other cross sectional configurations depending upon the exterior configurations of the connectors to be received within them. The provision of conductors of circular transverse cross section having annular clevis pin locking grooves formed therein is advantageous in that the conductors may be inserted onto a sleeve without concern with respect to rotative orientation of the conductor. However, when the present invention is applied to conductors having other than circular transverse configurations, the insulative housings of the conductors will be provided with a pair of separate grooves, one on each side, so positioned as to cooperate with the leg portions of the clevis locking pin.

Furthermore, while the use of a U-shaped clevis pin is preferred, it would be within the scope of the invention to use two separate pins (or even a single pin) as a locking means in the embodiments of the present invention. Thus, in the Figures, the legs **6*b* and 6*c* of clevis pin 6** could be considered to be separate pins.

What is claimed is:

1. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, the improvement comprising means to lock said connectors in said mated relationship, said locking means comprising a hollow shell having first and second open ends and a U-shaped clevis pin having a pair of legs connected at one end by a base portion, a first one of said connectors being partially insertable forward end foremost into said shell from said first end thereof, means to captively maintain said first connector in said shell, a second one of said connectors being partially insertable forward end foremost into said shell from said second end thereof and into mating relationship with said first connector, said shell near said second end thereof having first and second pairs of coaxial holes formed therein, each of said clevis pin legs being insertable in one of said first and second pairs of holes with that portion of each clevis pin leg extending between the holes of its respective pair thereof also extending into the interior of said shell and into engagement with said insulative housing said of second connector to lock said second connector in said shell and in said mating relationship with said first

2. The structure claimed in claim 1 wherein said first and second connectors each terminate at least one cable length, said connectors forming an in-line connection when mated, said means to maintain said first connector in said shell comprising a second U-shaped clevis pin having a pair of legs connected at one end by a base portion, said shell having near said first end thereof third and fourth pairs of coaxial holes formed therein, each of said legs of said second celvis pin being insertable in one of said third and fourth pairs of holes with that portion of each of said second clevis pin legs extending between the holes of its respective pair thereof also extending into the interior of said shell and into engagement with said insulative housing of said first connector.

3. The structure claimed in claim 1 wherein said first and second connectors each terminating at least one cable length, said connections forming an in-line connection when mated, said means to maintain said first connector in said shell comprising at least two diametrically opposed bolts threadedly engaged in said shell, said bolts extending into the interior of said shell and into engagement with said insulative housing of said first connector.

4. The structure claimed in claim 1 including a tether having a first end attached to said clevis pin and a second end attached to said shell to prevent loss of said clevis pin.

5. The structure claimed in claim 1 wherein said insulative housing of said second connector has at least one shoulder formed thereon, said at least one shoulder cooperating with said leg portions of said clevis pin to lock said second connector within said shell and in said mated relationship with said first connector.

6. The structure claimed in claim 1 wherein said insulative housing of said second connector has at least one groove therein engagable by said leg portions of said clevis pin to lock said second connector within said shell and in said mated relationship with said first connector.

7. The structure claimed in claim 2 including a tether for each of said clevis pins, each of said tethers having a first end attached to its respective one of said clevis pins and a second end attached to said shell to prevent loss of said clevis pins.

8. The structure claimed in claim 2 wherein said insulative housings of said both of said connectors each has at least one shoulder formed thereon, said at least one shoulder on each of said insulative housings cooperating with said leg portions of the adjacent one of said clevis pins to lock said connectors within said shell and in said mated relationship with each other.

9. The structure claimed in claim 2 wherein said insulative housings of both of said first and second connectors each has at least one groove therein engagable by said leg portions of the adjacent one of said clevis pins to lock said connectors within said shell and in said mated relationship.

10. The structure claimed in claim 3 wherein said insulative housing of said first connector has an annular groove formed therein, said bolts extending into said groove.

11. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, and a panel to which a first one of said connectors is mounted, the improvement comprising means to lock said connectors in said mated relationship, said locking means comprising a hollow shell having first and second open ends and a U-shaped clevis pin having a pair of legs connected at one end by a base portion, said first end of said shell having a laterally extending base member formed thereabout, said base member having a cavity formed therein, said first connector insulative housing having a laterally extending surrounding flange receivable within said cavity, said panel having a hole formed therein, said first connector having a rearward portion extending through said panel hole, fastening means attaching said shell base member to said panel with said insulative housing flange in compression between said base member and said panel so that said shell and said first connector are mounted on said panel with that part of said first connector within said shell being captively held therein and serving as a receptacle, a second one of said connectors being partially insertable forward end foremost into said shell from said second end thereof and into mating relationship with said first connector, said shell near said second end thereof having first and second pairs of coaxial holes formed therein, each of said clevis pin legs being insertable in one of said first and second pairs of holes with that portion of each clevis pin leg extending between the holes of its respective pair thereof also extending into the interior of said shell and into engagement with said insulative housing of said second connector to lock said second connector in said shell and in said mating relationship with said first connector.

12. The structure claimed in claim 11 wherein said first connector comprises said male connector and said second connector comprises said female connector.

13. The structure claimed in claim 11 wherein said first connector comprises said female connector and said second connector comprises said male connector.

14. The structure claimed in claim 11 including a tether having a first end attached to said clevis pin and a second end attached to said shell to prevent loss of said clevis pin.

15. The structure claimed in claim 11 including a pair of lug means on said shell so positioned with respect to said clevis pin that when said clevis pin is mounted in said first and second pairs of holes said base portion thereof lies between said lug means, each of said lug means having a perforation therethrough, locking means insertable through said lug means perforations and lockable therethrough, said locking means passing above said clevis pin base portion to prevent removal of said clevis pin from said first and second pairs of holes.

16. The structure claimed in claim 11 wherein said insulative housing of said second connector has at least one shoulder formed thereon, said at least one shoulder cooperating with said leg portions of said clevis pin to lock said second connector within said shell and in said mated relationship with said first connector.

17. The structure claimed in claim 11 wherein said insulative housing of said second connector has at least one groove therein engagable by said leg portions of said clevis pin to lock said second connector within said shell and in said mated relationship with said first connector.

18. The structure claimed in claim 17 including at least one insert imbedded in the exterior surface of said second connector insulative housing, said at least one groove being formed in said at least one insert.

19. The structure claimed in claim 18 wherein said second connector is circular in transverse cross section, said at least one groove comprising a single annular groove formed in a single annular insert.

20. The structure claimed in claim 11 including an annular reinforcing member surrounding said contact of said first connector, said insulative housing surrounding said contact and said reinforcing member with said reinforcing member extending into and reinforcing said insulative housing flange to maintain said contact of said first connector axially aligned within its housing.

21. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, the improvement comprising means to lock said connectors in said mated relationship, said locking means comprising a hollow shell having first and second open ends and a U-shaped clevis pin having a pair of legs connected at one end by a base portion, a first one of said connectors being partially insertable forward end foremost into said shell from said first end thereof, means to captively maintain said first connector in said shell, a second one of said connectors being partially insertable forward end foremost into said shell from said second end thereof and into mating relationship with said first connector, said shell near said second end thereof having first and second pairs of coaxial holes formed therein, each of said clevis pin legs being insertable in one of said first and second pairs of holes with that portion of each clevis pin leg extending between the holes of its respective pair thereof also extending into the interior of said shell and into engagement with said insulative housing of said second connector to lock said second connector in said shell and in said mating relaationship with said first connector, a pair of lug means on said shell so positioned with respect to said clevis pin that when said clevis pin is mounted in said first and second pairs of holes said base portion thereof lies between said lug means, each of said lug means having a perforation therethrough, locking means insertable through said lug means perforations and lockable therethrough, said locking means passing above said clevis pin base portion to prevent removal of said clevis pin from said first and second pairs of holes.

22. In an electrical connector assembly comprising a male connector with at least one male contact and a surrounding insulative housing and a female connector with at least one female contact and a surrounding insulating housing, said connectors being adapted to be mated at their forward ends with said at least one male contact in mated relationship with said at least one female contact and the forward ends of said insulative housings in mated relationship, said male and female connectors each terminating at least one cable length, said connectors forming an in-line connection when mated, the improvement comprising means to lock said connectors in said mated relationship, said locking means comprising a hollow shell having first and second open ends and first and second U-shaped clevis pins each having a pair of legs connected at one end by a base portion, a first one of said connectors being partially insertable forward end foremost into said shell from said first end thereof, a second one of said connectors being partially insertable forward end foremost into said shell from said second end thereof and into mating relationship with said first connector, said shell near said first end thereof having first and second pairs of coaxial holes formed therein, each of said legs of said first clevis pin being insertable in one of said first and second pairs of holes with that portion of each clevis pin leg extending between the holes of its respective pair thereof also extending into the interior of said shell and into engagement with said insulative housing of said first connector to lock said first connector in said shell and in mating relationship with said second connector, said shell near said second end thereof having third and fourth pairs of coaxial holes formed therein, each of said legs of said second clevis pin being insertable in one of said third and fourth pairs of holes with that portion of each leg of said second clevis pin extending between the holes of its respective pair thereof also extending into the interior of said shell and into engagement with said insulative housing of said second connector to lock said second connector in said shell and in said mating relationship with said first connector, a pair of lug means on said shell near each end thereof, each of said pairs of lug means being so positioned with respect to the adjacent one of said first and second clevis pins that when said adjacent clevis pin is mounted in its respective pairs of holes in said shell said base portion thereof lies between said pair of lug means, each lug means of said pairs thereof having a perforation therethrough, locking means for each of said pairs of lug means, each locking means being insertable through said lug means perforations of its respective lug means pair and lockable therethrough, said locking means passing above said base portion of its respective clevis pin to prevent removal of said clevis pin from its respective pair of holes.

23. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, the improvement comprising means to lock said connectors in said mated relationship, said locking means comprising a hollow shell having first and second open end and a U-shaped clevis pin having a pair of legs connected at one end by a base portion, a first one of said connectors being partially insertable forward end foremost into said shell from said first end thereof, means to captively maintain said first connector in said shell, a second one of said connectors being partially insertable forward end foremost into said shell from said second end thereof and into mating relationship with said first connector, said second connector having at least one insert imbedded in the exterior surface of its insulative housing, at least one groove being formed in said at least one insert, said shell near said second end thereof having first and second pairs of coaxial holes formed therein, each of said clevis pin legs being insertable into one of said first and second pairs of holes with that portion of each clevis pin leg extending between the holes of its respective pair thereof also extending into the interior of said shell and into engagement with said at least one groove to lock said second connector in said shell and in said mating relationship with said first connector.

24. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, said first and second connectors each terminating at least one cable length, said connectors forming an in-line connection when mated, the improvement comprising means to lock said connectors in said mated relationship, said locking means comprising a hollow shell having first and second open ends and first and second U-shaped clevis pins each having a pair of legs connected at one end by a base portion, a first one of said connectors being partially insertable forward end foremost into said shell from said first end thereof, a second one of said connectors being partially insertable forward end foremost into said shell from said second end thereof and into mating relationship with said first connector, at least one insert imbedded in the exterior surface of each of said insulative housings of said first and second connectors, at least one groove being formed in said at least one insert of each of said first and second connectors, said shell near said first end thereof having first and second pairs of coaxial holes formed therein, each of said legs of said first clevis pin being insertable into one of said first and second pairs of holes with that portion of each clevis pin leg extending between the holes of its respective pair thereof also extending into the interior of said shell and into engagement with said at least one groove of said first connector to lock said first connector in said shell and in said mating relationship with said second connector, said shell near said second end thereof having third and fourth pairs of coaxial holes formed therein, each of said legs of said second clevis pin being insertable in one of said third and fourth pairs of holes with that portion of each clevis pin leg extending between the holes of its respective pair thereof also extending into the interior of said shell and into engagement with said at least one groove of said second connector to lock said second connector in said shell and in said mating relationship with said first connector.

25. The structure claimed in claim 24 wherein said first and second connectors are both of circular transverse cross section, said at least one groove of each of said connectors comprising a single groove formed in a single annular insert.

26. In an electrical connector assembly comprising a male connector with at least one male contact and a surrounding insulative housing and a female connector with at least one female contact and a surrounding insulative housing, said connectors being adapted to be mated at their forward ends with said at least one male contact in mated relationship with said at least one female contact and the forward ends of said insulative housings in mated relationship, the improvement comprising means to lock said connectors in said mated relationship, said locking means comprising a hollow shell having first and second open ends and at least one pin, a first one of said connectors being partially insertable forward end foremost into said shell from said first end thereof, means to captively maintain said first connector in said shell, a second one of said connectors being partially insertable forward end foremost into said shell from said second end thereof and into mating relationship with said first connector, said shell near said second end thereof having first and second pairs of coaxial holes formed therein, said at least one pin being insertable in one of said first and second pairs of holes with that portion of said pin extending between the holes of that pair thereof in which the pin is located also extending into the interior of said shell and into engagement with said insulative housing of second connector to lock said second connector in said shell and in said mating relationship with said first connector.

* * * * *